United States Patent [19]

Matikainen et al.

[11] Patent Number: 4,496,796

[45] Date of Patent: Jan. 29, 1985

[54] BUOYANT CABLE

[75] Inventors: Keijo E. Matikainen, Espoo; Raimo M. Järvinen, Hyrylä, both of Finland

[73] Assignee: Oy Nokia Ab, Helsinki, Finland

[21] Appl. No.: 514,822

[22] PCT Filed: Oct. 21, 1982

[86] PCT No.: PCT/FI82/00047

§ 371 Date: Jun. 21, 1983

§ 102(e) Date: Jun. 21, 1983

[87] PCT Pub. No.: WO83/01534

PCT Pub. Date: Apr. 28, 1983

[30] Foreign Application Priority Data

Oct. 23, 1981 [FI] Finland ..... 813332

[51] Int. Cl.[3] ..... H01B 7/12

[52] U.S. Cl. ..... 174/101.5; 174/70 A

[58] Field of Search ..... 174/70 A, 101.5

[56] References Cited

U.S. PATENT DOCUMENTS

| | | | |
|---|---|---|---|
| 2,435,956 | 2/1948 | Craig | 174/101.5 |
| 2,518,323 | 8/1950 | Hunter | 174/101.5 |
| 3,443,020 | 5/1969 | Loshigian | 174/101.5 |
| 3,699,237 | 10/1972 | Melia | 174/101.5 |
| 3,781,778 | 12/1973 | Sawin et al. | 174/101.5 X |
| 3,795,759 | 3/1974 | Rhyne | 174/101.5 |
| 4,090,168 | 5/1978 | Miller et al. | 174/101.5 X |
| 4,160,872 | 7/1979 | Lundberg et al. | 174/101.5 |

FOREIGN PATENT DOCUMENTS

| | | | |
|---|---|---|---|
| 1024228 | 1/1978 | Canada | 174/70 A |
| 2031529 | 12/1971 | Fed. Rep. of Germany | 174/101.5 |
| 3005615 | 8/1981 | Fed. Rep. of Germany | 174/101.5 |
| 965270 | 7/1964 | United Kingdom | 174/101.5 |
| 1229787 | 4/1971 | United Kingdom | 174/70 A |

*Primary Examiner*—John F. Gonzales
*Assistant Examiner*—Morris H. Nimmo
*Attorney, Agent, or Firm*—Finnegan, Henderson, Farabow, Garrett & Dunner

[57] ABSTRACT

The invention relates to a buoyant cable. The cable sheath (3) is divided into two portions (4 and 5) whereby the cable conductor (1) is placed in one (4) of the portions and the cable float (2) in the other portion (5). Thus, the cable conductor is substantially in communication with the surrounding water only through the conductor insulation (14) and the cable sheath (3).

6 Claims, 4 Drawing Figures

BUOYANT CABLE

Figure 1:
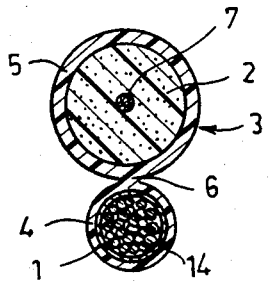

The present invention relates to a buoyant cable.

For example, from the Swedish Printed Specification No. 403,409 is known a buoyant cable in which the innermost part is the cable conductor around which a float is arranged, the cable sheath being arranged around said float.

A serious disadvantage associated with a buoyant cable of this kind is that the float layer surrounding the conductor also acts as an efficient heat insulation, due to which the cable will be excessively heated if high powers are transmitted through it. Another disadvantage of the known cable is that the cable will be relatively thick which impairs its bendability. In order to reduce the thickness of the cable, attempts have been made to make the float layer as lightweight as possible by making it hollow. Inspite of this, it has been necessary to resort to special solutions in order to obtain a good bendability, and a hollow float layer suffers from the disadvantage that if the cable is broken water will penetrate into the float layer, in which case the cable sinks.

The object of the invention is to provide a new and better buoyant cable than the known cables.

The buoyant cable according to the invention is mainly characterized in that the cable conductor and the cable float are arranged in different sheath portions which are externally connected to each other. Preferably the cable sheath is given a cross-section resembling the figure eight whereby the cable conductor is disposed in one of the loops of the eight and the float in the other loop.

A significant advantage of the buoyant cable according to the invention is that only the conductor insulation and the cable sheath are located between the conductor and the water and, accordingly, the water surrounding the cable is able to efficiently cool the cable conductor. Due to this, considerably higher powers can be transmitted by means of the cable according to the invention than by means of the known buoyant cables.

Another significant advantage of the cable according to the invention is that it very accurately follows the wake of a vessel towing the cable, which makes the cable especially advantageous for use in mine-sweeping narrow waters.

An additional advantage is a sufficiently good bendability for most practical purposes without any special arrangements, because both parts of the cable can be made relatively thin.

In order to take up longitudinal tensile stresses applied on the cable, a reinforcing wire can be provided in the float. A preferred reinforcing wire is aromatic polyamide fibers such as sold under the trademark Kevlar which has a low stretchability. In view of high tensile stresses, a plurality of reinforcing wires may be used, for example, by positioning one in the centre of the float and the remainder at the interface of the float and the cable sheath.

In the following the invention will be described with reference to the accompanying drawing, in which FIGS. 1 to 4 illustrate different embodiments of a cable according to the invention, in cross-sections.

Figure 2:
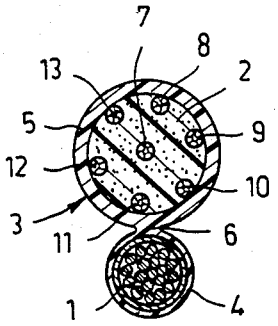

In two preferred embodiments of the invention, presented in FIGS. 1 and 2, the conductor of the buoyant cable is denoted by reference numeral 1, the float by reference numeral 2 and the cable sheath by reference numeral 3. The conductor 1 can comprise a stranded, for example, 19-thread aluminium wire, foamed polyethylene can be used as the float 2 and the cable sheath material can comprise, for example, Desmapon 588 polyurethane.

The cable sheath 3 is divided into two portions 4 and 5, for the cable conductor 1 and the float 2, respectively. The sheath portions 4 and 5 are connected to each other by means of a web 6 which is integrally connected to each sheath portion; thus, the cross-section of the cable sheath resembles the figure eight.

In the embodiment according to FIG. 1, a reinforcing wire preferably made of the material Kevlar is positioned in the centre of the float 2. The Kevlar wire is well suited for this purpose because of its lightness, strength and low stretchability. For taking up high tensile forces, a plurality of such wires may be used, in which case they can be preferably positioned along the periphery of the float in the manner shown in FIG. 2, reference numerals 8 to 13. Of course, also wires placed only along the periphery of the float could be used or, for example, wires embedded in the bends of the web 6.

Only the insulation 14 of the conductor and the sheath portion 4 of the cable are located between the conductor and the water surrounding the cable. These layers are both thin and, thus, the water is able to efficiently cool the conductor. The cable portions 4 and 5 are both rather thin which improves the bendability of the cable. Should the cable be broken, water is unable to penetrate into the float and the cable does not sink when the float is preferably made of foamed polyethylene having closed pores. Of course, also other lightweight, water-impermeable materials can be used for the float. Preferably the float material is of such hardness that it will not easily be compressed during use.

The buoyant cable floats in the position shown in the drawing and thereby provides a keel-effect due to which the cable with surprising accurateness follows the wake of a towing vessel.

Figure 3:
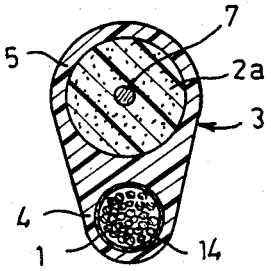
Figure 4:
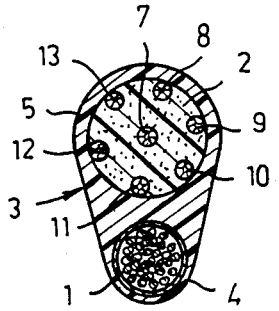

Alternative embodiments within the scope of the invention are illustrated in FIGS. 3 and 4.

Thus, a web separating the sheath portions 4 and 5 from each other is not indispensable (FIG. 4), and the portions 4 and 5 can be internally communicating with each other, the float 2*a* continuing to the conductor insulation 14, as in FIG. 3. What is essential is that the cable 1 is not positioned within the float 2 but is substantially in communication with the surrounding water only through the conductor insulation and the cable sheath.

In the buoyant cable of the invention, a separate and safe electrical connection of the conductor is possible, thereby further facilitating an effective, separately performed connection of the float part 2. In manufacturing the cable the float may, in a known manner, be made in a continuous foaming process, and the application of the cable sheath may likewise take place continuously, subsequent to the formation of the float and in a way known per se.

I claim:

1. A buoyant cable comprising:

(a) a conductor;

(b) a float for buoyantly supporting said conductor in water, said float being separate from said conductor; and (c) a cable sheath having connected sheath portions for said conductor and said float, said cable sheath surrounding said conductor and said float in said connected sheath portions to form a buoyant cable wherein heat is transmitted from said conductor into surrounding water substantially without passing through said float.

2. A buoyant cable according to claim 1, wherein said cable sheath is formed with a figure eight cross-section having two loops, said conductor being positioned in one loop and said float being positioned in the other loop.

3. A buoyant cable according to claim 1 or 2, wherein a wire for taking up tensile forces applied to said cable extends through said float.

4. A buoyant cable according to claim 3, wherein wires for taking up tensile forces applied to said cable are positioned at the periphery of said float.

5. A buoyant cable according to claim 4, wherein said wires are aromatic polyamide fibers.

6. A buoyant cable according to claims 1 or 2 wherein said float is made of foamed polyethylene having closed pores.

* * * * *